United States Patent [19]

Honnorat et al.

[11] 3,972,752

[45] Aug. 3, 1976

[54] ALLOYS HAVING A NICKEL-IRON-CHROMIUM BASE FOR STRUCTURAL HARDENING BY THERMAL TREATMENT

[75] Inventors: Yves Honnorat, Sauvingy-les-Bois; Andre Pineau, Evry; Ricardo Cozar, Ris-Orangis, all of France

[73] Assignee: Creusot-Loire, Paris, France

[22] Filed: Aug. 14, 1974

[21] Appl. No.: 497,478

Related U.S. Application Data

[63] Continuation-in-part of Ser. No. 288,071, Sept. 11, 1972, abandoned.

[30] Foreign Application Priority Data

Sept. 28, 1971 France ..... 71.34871

[52] U.S. Cl. ..... 148/162; 75/171; 148/32.5

[51] Int. Cl.[2] ..... C22F 1/10

[58] Field of Search ..... 148/162, 32.5, 32; 75/171, 170

[56] References Cited

UNITED STATES PATENTS

| | | | |
|---|---|---|---|
| 2,570,193 | 10/1951 | Bieber et al. | 148/162 |
| 3,046,108 | 7/1962 | Eiselstein | 148/162 |

*Primary Examiner*—R. Dean

*Attorney, Agent, or Firm*—Cameron, Kerkam, Sutton, Stowell & Stowell

[57] ABSTRACT

Method of preparation of an alloy comprising the steps of preparing a nickel-iron-chromium based alloy, placing the alloy in solution at temperatures between 925°C and 1060°C, followed by a quick cooling, aging the alloy at a first level of temperature and exposure time to obtain a precipitation of $\gamma'$ phase prior to a precipitation of a $\gamma''$ phase and reducing the temperature to a second level of at least 700°C.

3 Claims, 12 Drawing Figures

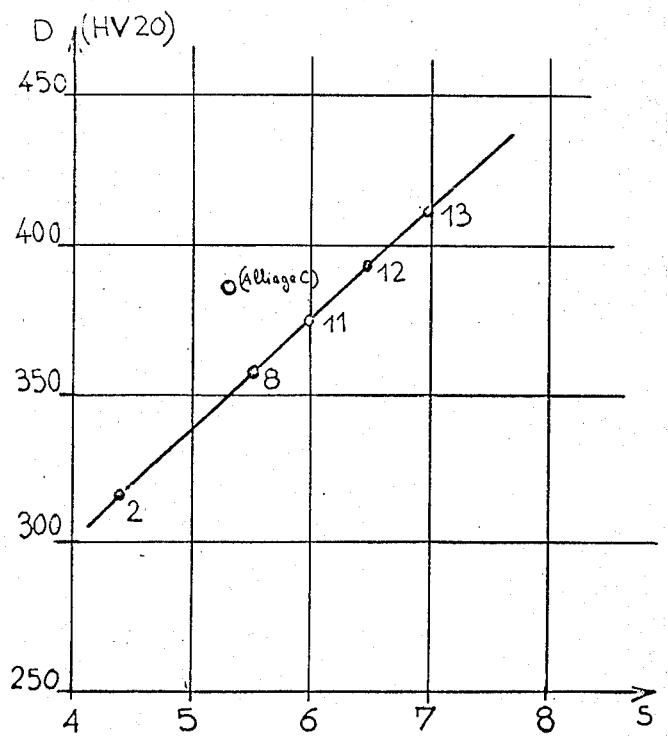
FIG:7
FIG:8
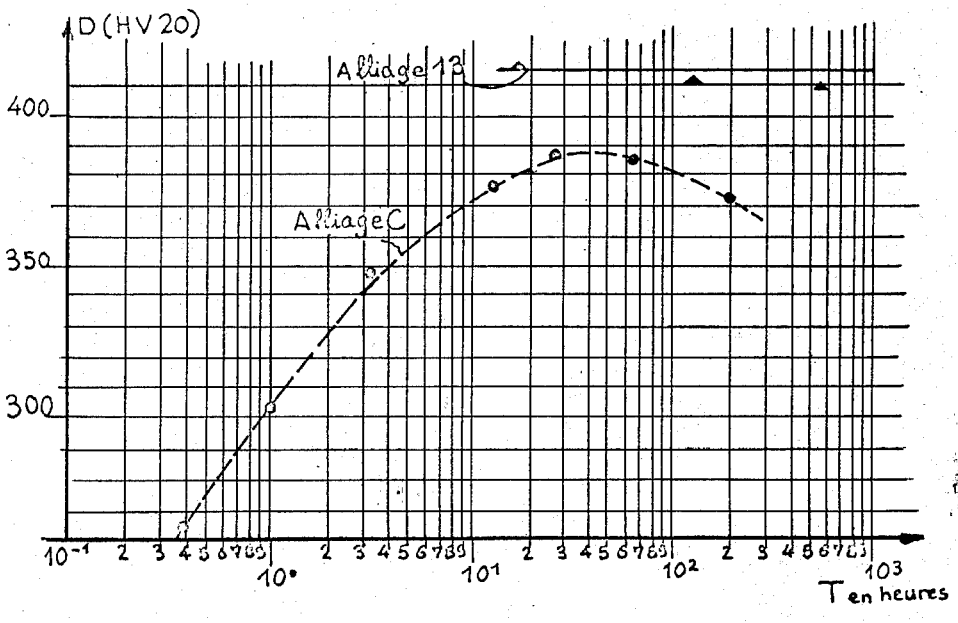

ALLOYS HAVING A NICKEL-IRON-CHROMIUM BASE FOR STRUCTURAL HARDENING BY THERMAL TREATMENT

REFERENCE TO RELATED APPLICATION

This application is a continuation-in-part of our application Ser. No. 288,071, filed Sept. 11, 1972, now abandoned.

BACKGROUND OF THE INVENTION

The present invention relates to high temperature nickel-iron-chromium-base alloys, having a specific hardening precipitation.

The present alloys are derived from an alloy described in U.S. Pat. No. 3,046,108 which includes Cr: 15 to 25 percent; Fe: up to 30 percent; Ni: 30 to 58 percent; Mo: 2 to 7 percent; C: up to 0.2 percent; Si: up to 0.5 percent; (Nb + Ta): 3 to 8 percent, (Ti + Al): 0.4 to 2.5 percent. These alloys contain a considerable quantity of iron which maintains high-level mechanical resistance and resistance to oxidation while limiting cost by limiting the nickel content. Chromium is essential to assure proper resistance against oxidation. A low silicon content is indispensable to obtain a good welding point. Present in low quantity, carbon takes a part in the material's resistance to distortion because, during thermal treatments, it results in the precipitation of localized carbides at the joints of the grains. During thermal treatment, the additional elements, namely, niobium, tantalium, titanium and aluminium induce formations of particles of intermetallic phases which cause a hardening called "structural hardening."

To obtain structural hardening, the alloy is first subjected to a thermal treatment which brings the additional elements into solution; next, it is subjected to hardening, to bring the solution to a metastable state; precipitation not yet having occurred. This metastable solution state has a tendency to regain its equilibrium by rejecting a part of the additional elements as precipitates. Titanium and aluminium cause the formation of a cubic intermetallic phase with centered faces (CFC) of the $L1_2$ type which has a chemical composition of the $A_3B$ type, with A mostly representing nickel and B, mostly titamium and aluminium. This phase is designated by $\gamma'$.

Niobium and tantalium cause the formation of an intermetallic phase of a centered tetragonal structure type D022, which also has an $A_3B$ type composition, with A representing nickel and B niobium and/or tantalium. This phase is designated by $\gamma''$.

The precipitation of this known alloy has been studied by PAULONIS, OBLAK AND DUVAL in an article entitled "Precipitation in Nickel-Base Alloy F18" published in "Transactions of the ASM" in 1969. These authors were the first to show that type $\gamma'$ and type $\gamma''$ phases exist simultaneously in the alloy described in the previously mentioned patent. They have also shown that the $\gamma''$ precipitates appear as thin, small plates while the $\gamma'$ precipitates are generally spherical or cubical in shape. The $\gamma'$ and $\gamma''$ precipitates increase independently. They are sometimes separated in the matrix. The $\gamma'$ particles can also be joined to some $\gamma''$ particles with the $\gamma'$ phase, playing a minor part in the hardening.

These authors have shown that the $\gamma''$ is susceptible of a rapid coalescence at temperatures above 650°C which leads to a decrease in resistance.

The hardness of the alloy D, is known as a function of aging time T, at 750°C also shows that hardness D decreases rapidly during a prolonged exposure to this temperature. Modifications of the structure at temperatures above 650°C limit the use of the alloy to parts which will not be thermally exposed. Uses at temperatures above 650° can lead to premature breaks in service.

BRIEF DESCRIPTION OF THE INVENTION

The present invention overcomes these disadvantages. In order to do so, the contents of the additional elements are judiciously chosen and the alloy is subjected to a thermal treatment which is defined in time and temperature directly as a function of the composition. The hardening precipitation, then has a quite specific morphology which provides the alloy with a great resistance to overaging.

The alloy can be used for thermally exposed parts at temperatures up to 700°C. The present invention also provides methods for bringing about a precipitation resistant to hardening.

The alloys included in the present invention can be forged and laminated [rolled] when hot or cold. They can be used for high temperature parts such as casings or aeronautical turbine discs.

The present alloy comprises:

15 to 25 percent iron,
15 to 25 percent carbon,
up to 0.35 percent silicon,
up to 0.35 percent manganese,
up to 0.01 percent sulphur,
up to 0.01 percent phosphorus,
2.5 to 9 percent molybdenum,
1.5 to 6.5 percent of niobium, which can be partially replaced by tantalium,
0.5 to 1.5 percent titanium,
0.3 to 1.5 percent aluminium,
up to 0.01 percent boron,
and the balance nickel, precipitates made up of a cubical nucleau of at least 200 A formed by a cubic structure phase with centered faces approximating $Ni_3$ (Ti, Al, Nb), and of precipitates in the form of small plates composed of a centered tetragonal structure phase, approximating $Ni_3$ (Nb, Ta) covering over the six faces of the nucleus.

The contents of niobium, tantalium, titanium, aluminium are such that the ratio R of the sum of the atomic percentages of titanium and aluminium and the sum of the atomic percentages of niobium and tantalium, on the one hand, and the sum S of atomic percentages of niobium, tantalium, titanium and aluminium, on the other hand, have values included in the perimeter defined by straight lines M, N, P, to be discussed hereinafter.

The method of preparing the present alloy includes the steps of:

preparing the alloy starting with:
15 to 25 percent iron,
15 to 25 percent chromium,
0.01 to 0.2 percent carbon,
up to 0.35 percent silicon,
up to 0.35 percent manganese,
up to 0.01 percent sulphur,
up to 0.01 percent phosphorus,
2.5 to 9 percent molybdenum,
1.5 to 6.5 percent niobium, which can be partially replaced by tantalium, 0.5 to 1.5 percent titanium,
0.3 to 1.5 percent aluminium,
up to 0.01 percent boron,
nickel providing the balance, $$\text{ratio } R \text{ of atomic percentages } \frac{\text{titanium} + \text{aluminium}}{\text{niobium} + \text{tantalium}}$$

and sum $S$ of atomic percentages titanium + aluminium + niobium + tantalium, being included inside the field limited by lines M, N, P, to be further described hereinafter, submitting the alloy to a solution treatment between 925° and 1060°C followed by a quick cooling, submitting the alloy to an aging treatment, starting with a first level whose temperature and exposure time causes a precipitation of cubes of at least 200A of a $\gamma'$ phase prior to a precipitation of phase $\gamma''$, followed by a slow reduction of temperature to a second level.

BRIEF DESCRIPTION OF THE DRAWINGS

The invention will now be described in further detail with reference to the accompanying drawing in which:

FIG. 7 shows the influence of the hardening elements content on the hardness of the alloys, having a precipitation which resists overaging;

FIG. 8 shows the hardening evolution of an alloy at 700°C, according to the present invention and that of a known alloy.

DESCRIPTION OF THE PREFERRED EMBODIMENTS

The weight of the alloys according to the present invention is 15 to 25 percent iron; 15 to 25 percent chromium; 0.01 to 0.2 percent carbon; up to 35 percent silicon; up to 0.35 manganese; up to 0.01 percent phosphorus; up to 0.01 percent sulphur; 2.5 to 9 percent molybdenum; between 1.5 and 6.5 percent niobium plus tantalium; between 0.5 and 1.5 percent titanium; between 0.3 and 1.5 percent aluminium; the balance being nickel. Half of the niobium content can be replaced by tantalium. Twice the weight of tantalium compared to niobium is needed in order to obtain the same effect on the properties.

The alloys can contain up to 0.01 percent of boron in order to diminish the intergranulary fragility in traction and creeping after prolonged exposure up to about 700° to 800°C. This fragility is probably due to the formation at the joints of the grains of a quasi continuous film of carbides of type (Nb, Ti)C.

Figure 1:
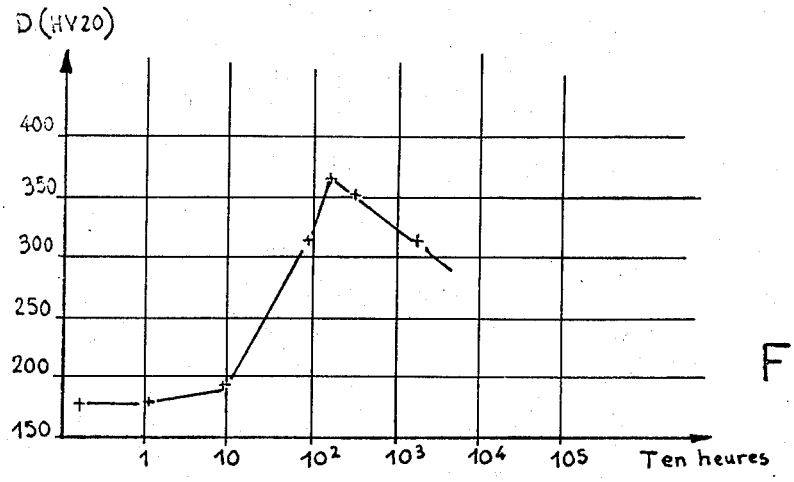
FIG. 1 relates to the known alloy D as referred to above.
Figure 2:
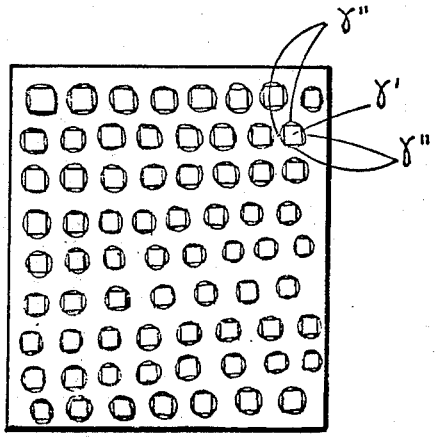
FIG. 2 shows schematically the morphology of the precipitates of the alloys of the present invention.

This invention is based on the discovery that the qualities of the alloys whose composition and treatment are in conformity with the present invention are due to a previously unknown specific morphology of the precipitates in which phases $\gamma'$ and $\gamma''$ are associated. This morphology, shown in FIG. 2, is very stable in the course of time and provides the alloy with great resistance to overaging.

Each of the precipitates is formed by a cube of at least 200A per side and is composed of a phase $\gamma'$ cubic in structure with centered faces approximating $Ni_3$ (Ti, Al, Nb) and by little plates covering the six faces of the cube which are formed by a centered tetragonal structure phase $\gamma''$ approximately $Ni_3$ (Nb, Ta).

The alloy's specific precipitation can be obtained only, on the one hand, through a selected composition within prescribed limits, and on the other hand, by a thermal treatment established as a function of the selected composition.

It has been noted that the ratio $$R = \frac{\text{volume fraction of phase } \gamma'}{\text{volume fraction of phase } \gamma''}$$

increases as the ratio $$R = \frac{\text{Ti} + \text{Al}}{\text{Nb} + \text{Ta}}$$

increases. The ratio must be between a lower value in order for the $\gamma''$ small plates not to extend beyond the faces of the precipitates, and a higher value for the faces of the precipitates to cover the faces of the $\gamma'$ cubes.

It has been noted moreover that hardness is a function of sum S of the atomic percentages of the titanium, aluminium, niobium and tantalium elements.

In order to obtain the above described precipitation, a specific composition must be used which will be described below.

In the series of compositions defined above, the ratio $$R = \frac{\text{Ti} + \text{Al}}{\text{Nb} + \text{Ta}}$$

(in atomic percentages) vary within wide limits.

The elaboration and study of numerous alloys whose compositions are defined in Chart I below has made it possible to define, as a function of R and S parameters, a plurality of compositions providing, after appropriate thermal treatment, the specific morphology previously discussed.

Figure 3:
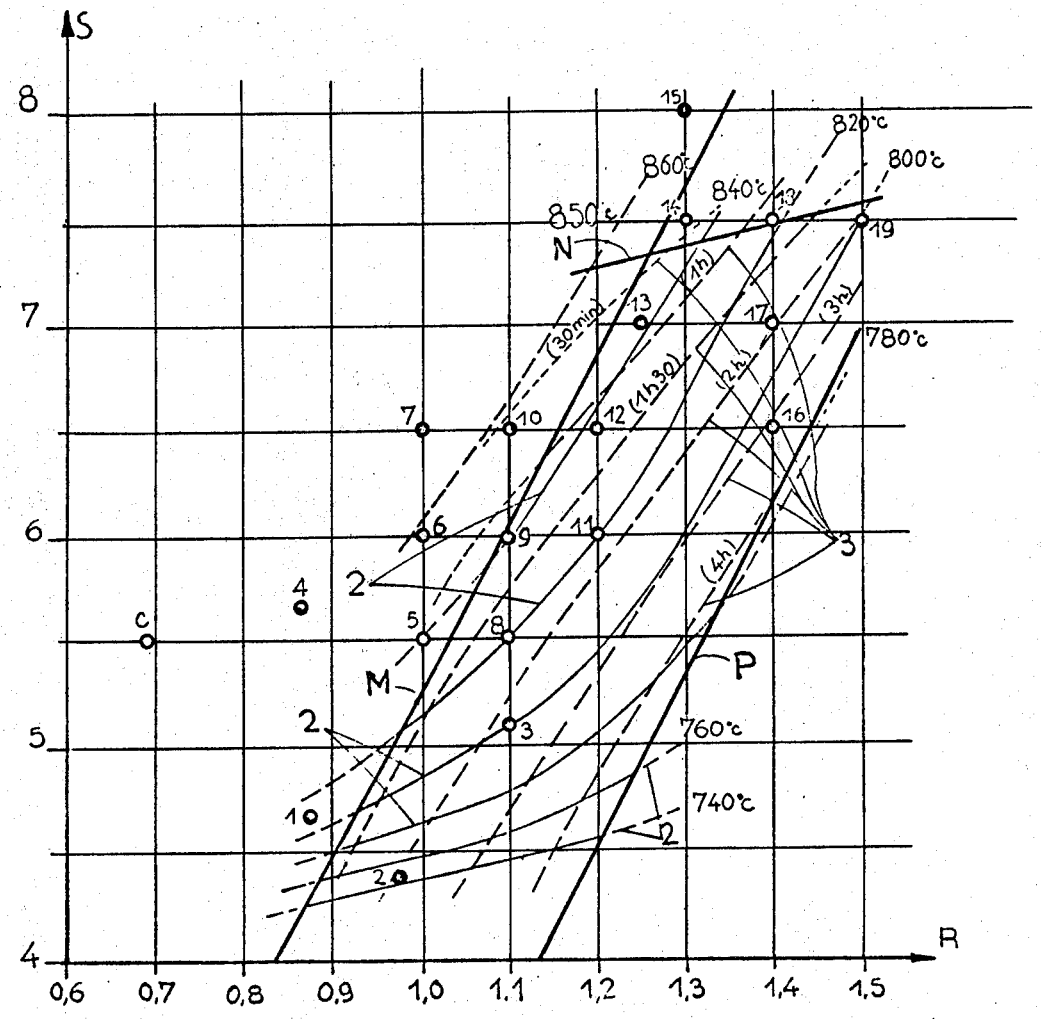
FIG. 3, by parameters R and S, and lines M, N and P defines the compositions of alloys which have the specific precipitation that resists overaging and defines for each composition the treatment conditions necessary to achieve the said precipitation.

These compositions defined by parameters R and S are shown in FIG. 3 by lines M, N, and P. The compositions included within this field provide the compact morphology, after thermal treatments.

The alloys whose compositions are such that the R and S parameters are located in FIG. 3 to the left of line M have a ratio $$R = \frac{\text{volume fraction of } \gamma'}{\text{volume fraction of } \Delta''}$$

which is too low. It can be estimated that this ratio must at least be equal to 2. This can prevent the formation of precipitates according to FIG. 2 or lead to the destruction of these precipitates by $\gamma''$ small plates going beyond the $\gamma'$ faces.

The alloys whose compositions have R and S parameters located to the right of line P give precipitates which do not have sufficient phase $\gamma''$ to cover the $\gamma'$ cubes. They do not have sufficient resistance to overaging.

pears prior to phase $\gamma''$. The curve B defines the conditions by which phase $\gamma'$ reaches the critical size of 200A. The maximum temperature $\theta_m$ is that above which the precipitation of $\gamma'$ and $\gamma''$ occurs only on the flaws of the structure. The treatment must be carried out at a temperature between $\theta_o$ and $\theta_m$.

The $\gamma'$ speed of growth is slowed considerably as soon as $\gamma''$ appears. It may be though that as soon as $\gamma''$ has coated the six faces of $\gamma'$, the $\gamma'$ cannot grow easily because of the fact that the diffusion speeds of titanium and aluminium are limited through phase $\gamma''$. The coating of $\gamma'$ by $\gamma''$ shows a practical way to limit the growth of hardening particles and therefore prevent the

CHART I

| Designation of The Alloy | COMPOSITION | | | | | | | | | | | | | | PARAMETERS | |
|---|---|---|---|---|---|---|---|---|---|---|---|---|---|---|---|---|
| | C | Si | S | P | Mn | Fe | Cr | Mo | Ti | Al | Nb | Ta | B | Ni | S | R |
| KNOWN ALLOY C | 0.06 | 0.09 | 0.005 | 0.007 | 0.05 | 20.0 | 19. | 3.0 | 0.80 | 0.60 | 5.2 | — | 0.005 | Balance | 5.51 | 0.69 |
| 1 | 0.07 | 0.05 | 0.003 | 0.006 | 0.08 | 21.0 | 18.6 | 2.8 | 0.72 | 0.63 | 4.0 | — | 0.005 | " | 4.70 | 0.89 |
| 2 | 0.06 | 0.12 | 0.004 | 0.007 | 0.06 | 17.2 | 18.9 | 7.0 | 0.53 | 0.63 | 3.41 | — | 0.005 | " | 4.24 | 0.97 |
| 3 | 0.06 | 0.15 | 0.005 | 0.005 | 0.03 | 16.6 | 18.9 | 7.0 | 0.90 | 0.74 | 3.85 | — | 0.005 | " | 5.14 | 1.1 |
| 4 | 0.07 | 0.15 | 0.004 | 0.005 | 0.03 | 15.2 | 18.9 | 6.1 | 0.89 | 0.70 | 3.50 | 2.4 | 0.005 | " | 5.67 | 0.87 |
| 5 | 0.03 | 0.16 | <0.002 | 0.002 | 0.08 | 18.8 | 19.1 | 3.0 | 0.86 | 0.80 | 4.43 | — | " | " | 5.50 | 1.00 |
| 6 | 0.04 | 0.20 | " | 0.002 | 0.09 | 18.2 | " | " | 0.93 | 0.88 | 4.83 | — | " | " | 6.00 | " |
| 7 | 0.07 | 0.15 | " | 0.003 | 0.10 | 17.8 | " | " | 1.01 | 0.95 | 5.22 | — | " | " | 6.50 | " |
| 8 | 0.05 | 0.21 | " | 0.002 | 0.09 | 18.8 | " | " | 0.90 | 0.84 | 4.23 | — | " | " | 5.50 | 1.10 |
| 9 | 0.06 | 0.19 | " | 0.002 | 0.09 | 18.3 | " | " | 0.98 | 0.92 | 4.60 | — | " | " | 6.00 | " |
| 10 | 0.06 | 0.20 | " | 0.003 | 0.10 | 17.8 | " | " | 1.06 | 1.00 | 4.99 | — | " | " | 6.50 | " |
| 11 | 0.04 | 0.21 | " | 0.002 | 0.09 | 18.4 | " | " | 1.04 | 0.96 | 4.37 | — | " | " | 6.00 | 1.20 |
| 12 | 0.08 | 0.11 | 0.005 | 0.004 | ≦0.01 | 17.8 | " | " | 1.11 | 1.04 | 4.77 | — | " | " | 6.50 | " |
| 13 | 0.07 | 0.12 | 0.02 | 0.003 | ≦0.01 | 17.4 | " | " | 1.21 | 1.14 | 5.02 | — | " | " | 7.00 | 1.25 |
| 14 | 0.05 | 0.20 | " | " | " | 16.8 | " | " | 1.32 | 1.24 | 5.26 | — | " | " | 7.50 | 1.30 |
| 15 | 0.05 | 0.20 | " | " | " | 16.3 | " | " | 1.41 | 1.33 | 5.61 | — | " | " | 8.00 | " |
| 16 | 0.05 | 0.20 | " | " | " | 18.0 | " | " | 1.18 | 1.11 | 4.38 | — | " | " | 6.50 | 1.40 |
| 17 | 0.05 | 0.20 | " | " | " | 17.5 | " | " | 1.28 | 1.20 | 4.72 | — | " | " | 7.00 | " |
| 18 | | 0.20 | " | " | " | 16.9 | " | " | 1.37 | 1.28 | 5.06 | — | " | " | 7.50 | " |
| 19 | 0.05 | 0.20 | " | " | " | 17.1 | " | " | 1.41 | 1.32 | 4.85 | — | " | " | 7.50 | 1.50 |

The alloys whose compositions have a parameter higher than 7.5 (line N) have a tendency to crack during forging.

The alloys whose compositions have a parameter S, lower than 4, lead to a too weak volume fraction of particles, which leads to a limited hardening.

The alloys are prepared by the classic methods of electrical steel works and preferably with an induction furnace under vacuum. In order to improve their cleanliness and decrease their gas content, the preparation will then be preferably followed by a refusion in a consumable electrode furnace.

The alloy must be subjected to a solution or normalization treatment at a temperature between 925°C and 1060°C, followed by a tempering in a gaseous fluid or liquid. Thereafter, a tempering treatment, according to the composition, is performed.

It has been noted that phase $\gamma'$ appears prior to phase $\gamma''$. Moreover, it has been noted that the specific morphology described above, can be formed only if the precipitates $\gamma'$ have reached a critical size before the $\gamma''$ precipitation, the critical size approximating 200A.

The precipitation mechanism will be explained with reference to FIG. 4 where the abscissa T is the exposure time of the alloy to the tempering temperature and the ordinate $\theta$ is the tempering temperature of the alloy. For a given alloy the curve defines time and temperature conditions from which a $\gamma''$ precipitation can be obtained. It is also possible to define the conditions according to which phase $\gamma'$ appears since it apalloys from overaging.

If the desired morphology is not attained in the first stages of the precipitation either because the composition is not suitable or because the tempering temperature is not properly selected, it does not form thereafter and on the contrary, the $\gamma'$ and $\gamma''$ precipitates have a tendency to separate and grow independently.

In order to obtain the desired compact morphology, the $\gamma'$ precipitates must reach a critical size of 200A before the $\gamma''$ precipitation starts on the $\gamma'$ cubes.

Figure 4:
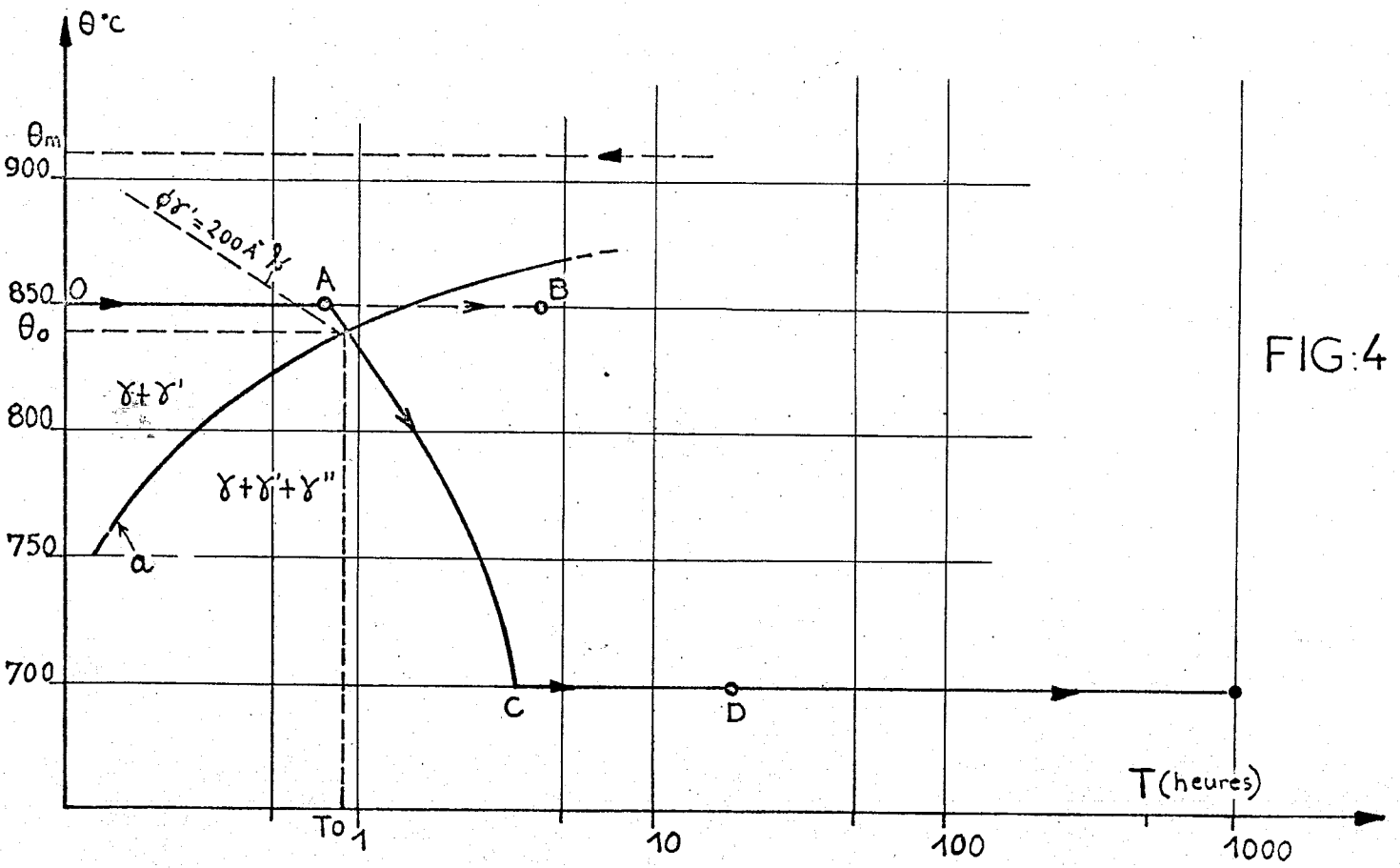
FIG. 4 is a diagram of phases relating to an alloy with a high S, as a function of temperature and time of exposure, and of the thermal aging treatment leading to the desired precipitation.
Figure 5A:
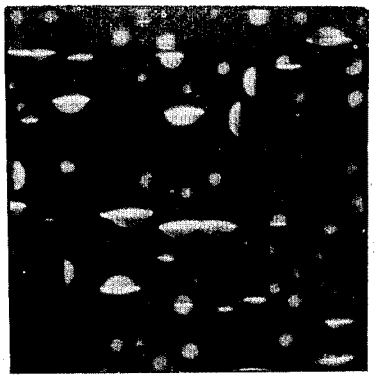
FIG. 5 reproduces electronic microscope photographs of the alloy having a high parameter S, at different stages of the treatment.
Figure 5B:
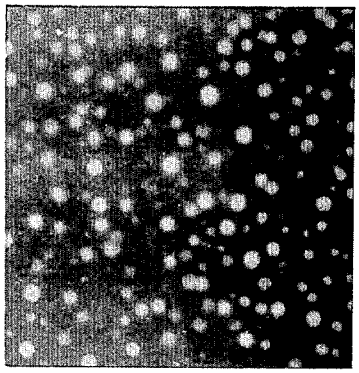
Figure 5C:
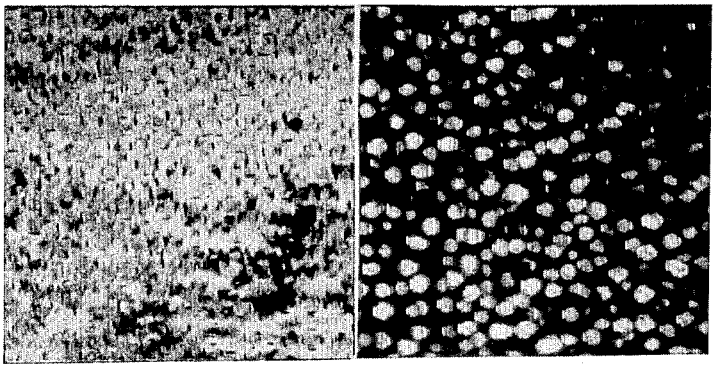
Figure 5D:
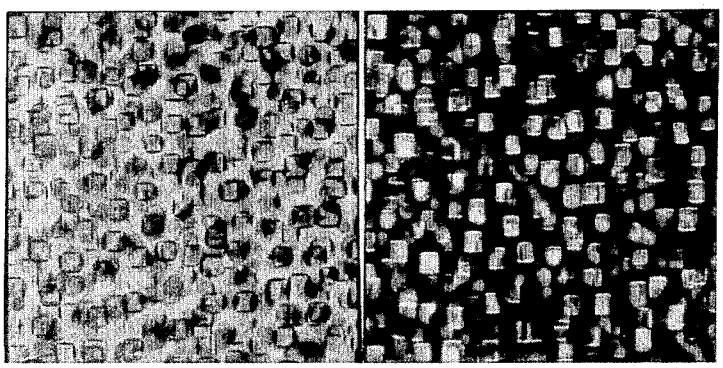
Figure 6:
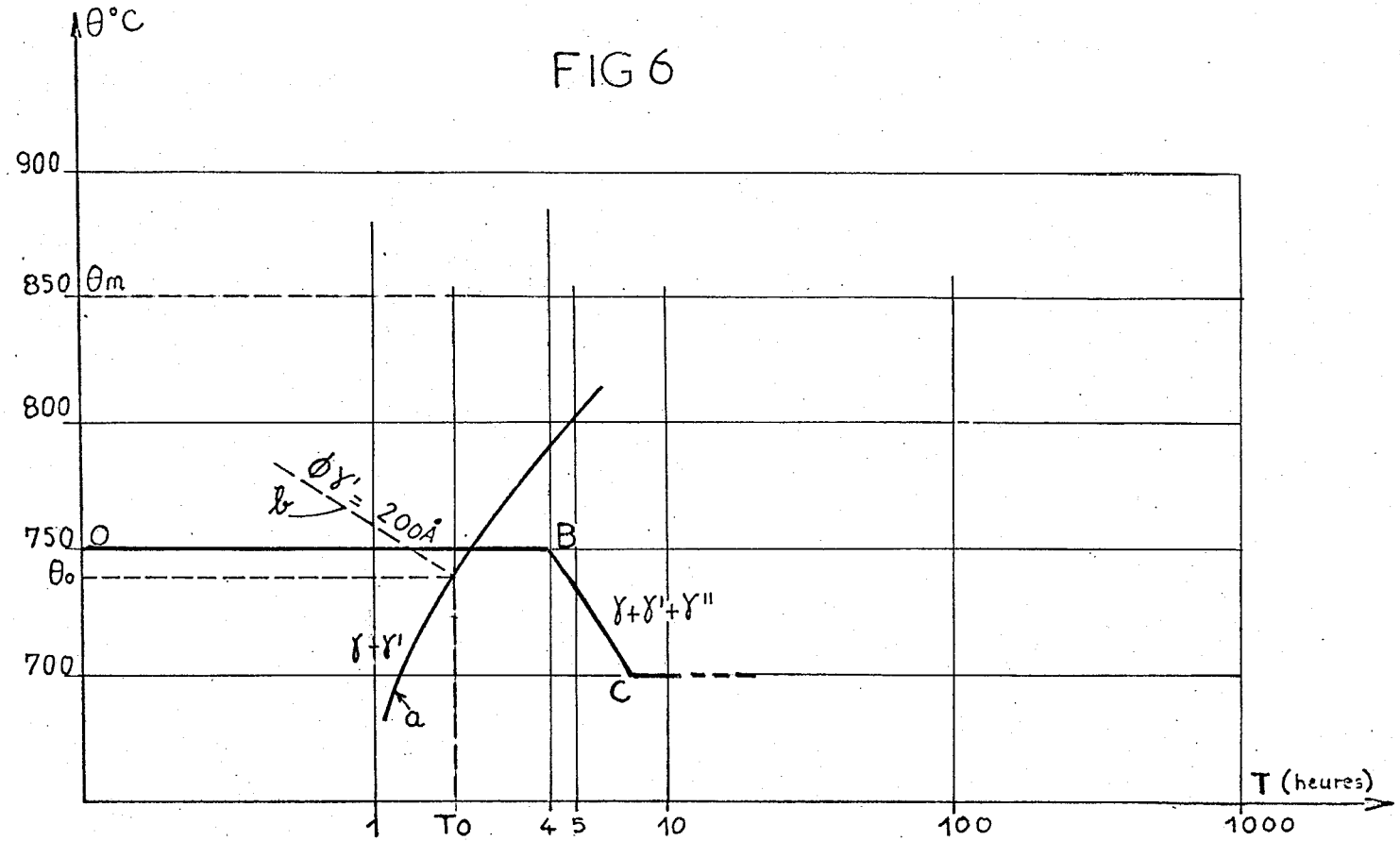
FIG. 6 is a diagram of phases relating to an alloy having a weak parameter S and a diagram of the thermal treatment of aging which produces the desired precipitation.

FIGS. 4 and 6 gives as a function of the temperature $\theta$ on the ordinate and duration T of temperature exposure on the abscissa, the diagram of the phases present respectively in alloy 13 (FIG. 4) and in alloy 2 (FIG. 6), each curve A separating field $\gamma + \gamma'$ and field $\gamma + \gamma' + \gamma''$.

The temperature at the beginning of the tempering must be lower than $\theta_m$, the maximum temperature of homogeneous precipitation. The temperature at the beginning of the tempering must at least be equal to $\theta_o$ in order for the nucleus to reach the critical size. At temperature $\theta_o$, an exposure duration To allows $\gamma'$ to reach the size of 200A when $\gamma''$ appears.

FIG. 3 gives as a function of parameters R and S of the compositions, by curves 2, the temperature $\theta_o$, and by the curves 3, the time To required for the precipitation of cubes $\gamma'$ to have the dimension of 200A when $\gamma''$ appears.

It has been discovered that in alloys having compositions with a parameter S ≥ 5.5, the precipitates with a morphology conforming to FIG. 2 do not form directly.

After a prolonged exposure (4 hours), at the initial temperature (OB treatment of FIG. 4) the desired precipitation is not formed as is shown in microphotograph 5*a*.

The temperature is close to the limit of precipitation of $\gamma''$ and therefore the $\gamma''$ germination speed is weak while the number of sites to be occupied (all of the faces of particles $\gamma'$) is large.

It has been discovered that the desired morphology can be reached if the temperature is lowered before the $\gamma''$ appear (curve A), the level before the temperature reduction being designated OA on FIG. 4, the reduction being designated AC.

The electronic microphotograph 5*b* shows at the end of level OA, the structure of the alloy without phase $\gamma''$. After having formed $\gamma'$ particles at least equal to 200A in dimension, the temperature is reduced relatively slowly (about 50°C/h).

The desired precipitation can then be obtained. This is explained by the reduction following AC, of the temperature treatment leads to a significant increase in the germination speed of $\gamma''$, which may then cover all the faces of particles $\gamma'$ present. Furthermore, by reducing the temperature, after having obtained the critical size of 200A, the growth of $\gamma'$ particles is avoided during the $\gamma''$ precipitation.

Microphotograph 5c is that of an alloy which has been subjected to treatment OACD (FIG. 4) and shows the desired precipitation. Microphotograph 5*d* shows that after prolonged OACE treatment of the same alloy, there is little change in the precipitation.

Chart II gives the tempering treatments of alloys 12 to 19 which have a parameter S at least equal to 6.5.

CHART II

| Alloy | Hardened Tempering | | | | | |
|---|---|---|---|---|---|---|
| 12 | 835°C | (1h10) | 50°C/h → | 650° | (16h) | air temper |
| 13 | 840°C | (50mn) | 50°C/h → | 650° | (16h) | air temper |
| 16 | 795°C | (3h15) | 50°C/h → | 650° | (16h) | air temper |
| 17 | 810°C | (2h) | 50°C/h → | 650° | (16h) | air temper |
| 19 | 800°C | (2h) | 50°C/h → | 650° | (16h) | air temper |

FIG. 8 shows the proper stability of alloy 13 in relation to known alloy C during exposure at 700°C. Alloy 13 had been previously treated identically to that shown in FIG. 4, while for alloy C there was a direct treatment at 700°C where an overaging appeared after approximately 100 hours of exposure at this temperature. The hardness of alloy 13, on the other hand, remained unchanged during the exposure.

In alloys whose parameter S is lower than 5.5, the $\gamma'$ cubes still must reach the critical size when $\gamma''$ appears. FIG. 3 defines, for each composition, by curves 2, the critical temperature $\theta_o$ and by curves 3, the critical time To for the critical size to be reached when $\gamma''$ appears. As soon as the duration of the tempering is higher than To, the $\gamma''$ precipitation takes place. The initial level OB (FIG. 6) can have a duration longer than the time of appearance of phase $\gamma''$.

It has been found that if the precipitation temperature is lowered slowly (25°C/h approximately), after having reached the proper morphology, the morphology is preserved by increasing the precipitated volumetric fraction and thus the hardening.

This explains the hardening tempering curve of FIG. 6. In other words, a prior treatment at the highest temperatures to form the proper morphology of the precipitates, then a slow reduction in temperature followed by an isothermal exposure to increase the precipitated volumetric fraction and improvement in the mechanical characteristics of the alloy.

The temperature $\theta_2$ of the second level can be lower than 700°C (usually 650°C) to increase the precipitated volumetric fraction.

Table III gives, as an example, the treatment of alloys 2 and 3.

TABLE III

| Alloy | Tempering | Hardening Tempering |
|---|---|---|
| 2 | 1050°C (1h) air tempering | 750°C (4h) 25°C/h → 700°C (24h) 25°C/h → 600°C air tempering |
| 3 | 1050°C (1h) air tempering | 775°C (4h) 25°C/h → 725°C (24h) 25°C/h → 600°C air tempering |

The level of hardness reached by the alloys previously described is higher as the sum of hardening elements S is greater. FIG. 6 shows as a function of sum S of the atomic percentages of the additional elements, the hardness D at 700°C (expressed in units HV20) of alloys 2, 8, 11, 12, 13, after formation of the precipitation shown in FIG. 2. It may be noted that it is advantageous, in order to obtain good mechanical properties, to use an alloy which has a high parameter S (alloy 13, for example). Table IV shows the results of traction experiments performed on alloy 13 and on known alloy C. This table shows that the mechanical properties of the alloys according to the invention are superior to those of the known alloy.

Figure 9:
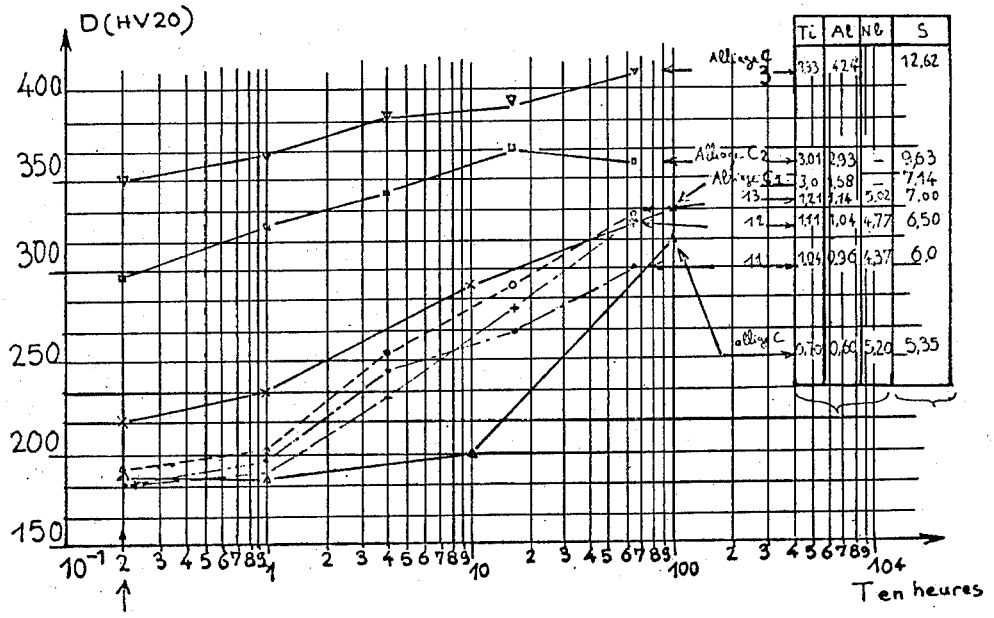
FIG. 9 shows hardening kinetics of the alloy in accordance with the present invention and of known alloys of the same type.

FIG. 9 shows that known alloy C has good welding properties because it has very slow hardening kinetics compared to the known nickel-based superalloys $C_1$, $C_2$, $C_3$ hardened by $\gamma'$ alone. FIG. 9 shows that the hardening kinetics of the alloys is faster when the sum S of hardening elements is higher. Alloys $C_2$, $C_3$, the kinetics of which are very fast, are not used for welded assemblies. On the other hand, alloy C is used in such assemblies but it can be considered as representing the limit of such use. Therefore, it could be thought that alloys 11, 12 and 13 would have a lower weldability than that of alloy C but remains satisfactory if its hardening kinetics are compared to that of alloy $C_1$.

As an optional embodiment, an intermediate treatment may be performed between the bringing to solution and hardening treatment lasting between 30 minutes and 16 hours at a temperature between 825°C and 925°C. The purpose of this intermediary treatment is to precipitate the carbides into the alloys which has not occurred during the two other treatments. This treatment prevents fragilization that would occur by carbide precipitation under constraint.

TABLE IV

| ALLOYS | EXPERIMENT'S TEMPERATURE (0°C) | ELASTIC LIMIT AT 0.2% OF LENGTHENING (Hectobars)+ | RESISTANCE TO THE TRACTION (Hectobars) | LENGTHENING AT THE BREAK+ |
|---|---|---|---|---|
| Alloy C* | 20° | 111.0 | 139.4 | 28.4 |
| Alloy 13* | | 113.8 | 150.8 | 23.2 |
| Alloy C* | 550° | 96.1 | 117.5 | 22.0 |
| Alloy 13* | | 99.0 | 130.2 | 17.0 |
| Alloy C* | 650° | 93.2 | 115.6 | 25.6 |
| Alloy 13* | | 96.4 | 125.3 | 21.6 |
| Alloy C* | 700° | 92.0 | 106.4 | 19.4 |
| Alloy 13* | | 95.0 | 116.8 | 17.8 |

+Lengthening = of the duration (time) or length.

*TREATMENTS

HOMOGENIZATION: 1050°C (30 min.) cooling 100°C/H also translateable as normalization: 955°C (30 min.) water dipping (temper)

HARDENING:

Alloy C: 750°C (8h) — cooling 50°C/H
650°C (8h) — water dipping (temperature)

Alloy 13: 850°C (1h) — cooling 50°C/H
650°C (16h) — water dip*

*DIP- Trempe a l'eau can also be translated as Water Tempering.

CONVERSION OF CENTIGRADES INTO FAHRENHEIT IN REFERENCE WITH CHART IV
20°C = 60°F; 50°C = 122°F; 550°C = 1022°F; 650°C = 1202°F; 700°C = 1292°F; 620°C = 1148°F; 850°C = 1562°F
750°C = 1382°F

What we claim is:

1. Method of preparation of an alloy comprising the steps of:

preparing an alloy consisting essentially of:

15 to 25 percent iron,
15 to 25 percent chromium,
0.01 to 0.2 percent carbon,
up to 0.35 silicon,
up to 0.35 percent manganese,
up to 0.01 percent sulphur,
up to 0.01 percent phosphorus,
2.5 to 9 percent molybdenum,
1.5 to 6.5 percent niobium, up to half of which can be replaced by tantalium,
0.5 to 1.5 percent titanium,
0.3 to 1.5 percent aluminium,
up to 0.01 percent boron,
and the remainder nickel, having a ratio $R$ of atomic percentages $\frac{\text{titanium + aluminium}}{\text{niobium + tantalium}}$ and sum S of atomic percentages of titanium + aluminium + niobium + tantalium, within the area defined by lines M, N, P, of FIG. 3, placing the alloy in solution at temperatures between 925°C and 1060°C, followed by a quick cooling, aging the alloy at a first level of temperature and exposure time to obtain a precipitation of cubes of at least 200A of a $\gamma'$ phase with centered faces approximately $Ni_3$ (Ti, Al, Nb) prior to a precipitation of plates of phase $\gamma''$ of centered tetragonal structure approximately $Ni_3$ (Nb, Ta) and reducing the temperature to a second level of at least 700°C.

2. Method of preparation of an alloy as described in claim 1:

the alloy including amounts of titanium, aluminium, niobium and tantalium such that sum S is at least equal to 5.5, and the reduction of the aging temperature is started before phase $\gamma''$ appears.

3. Method of preparation of an alloy as described in claim 1, the aging temperature and duration of said first aging level being shown in FIG. 4.

* * * * *